US010143609B2

(12) United States Patent
Chiang et al.

(10) Patent No.: US 10,143,609 B2
(45) Date of Patent: Dec. 4, 2018

(54) MEDICAL AIR MATTRESS

(75) Inventors: Kuang-Neng Chiang, Taipei (TW); Hsiu-Lun Liang, Taipei (TW)

(73) Assignee: Picard Healthcare Technology (Dongguan) Co. Ltd., Dongguan (CN)

( * ) Notice: Subject to any disclaimer, the term of this patent is extended or adjusted under 35 U.S.C. 154(b) by 658 days.

(21) Appl. No.: 13/159,860

(22) Filed: Jun. 14, 2011

(65) Prior Publication Data

US 2012/0317720 A1 Dec. 20, 2012

(51) Int. Cl.

| | |
|---|---|
| ***A47C 27/10*** | (2006.01) |
| ***A61G 7/057*** | (2006.01) |
| ***A61G 7/02*** | (2006.01) |
| *A61G 7/008* | (2006.01) |
| *A61G 7/05* | (2006.01) |
| *A61G 7/10* | (2006.01) |

(52) U.S. Cl.

CPC ..... *A61G 7/05776* (2013.01); *A61G 7/02* (2013.01); *A61G 7/008* (2013.01); *A61G 7/0525* (2013.01); *A61G 7/1009* (2013.01); *A61G 7/1021* (2013.01); *A61G 2210/90* (2013.01)

(58) Field of Classification Search

CPC ..... A47C 27/10
USPC ..... 5/709–711, 713–715, 655.3
See application file for complete search history.

(56) References Cited

U.S. PATENT DOCUMENTS

| | | | | |
|---|---|---|---|---|
| 2,998,817 | A | 9/1965 | Armstrong | |
| 3,653,083 | A | 4/1972 | Lapidus | |
| 3,678,520 | A * | 7/1972 | Evans | 5/713 |
| 4,193,149 | A | 3/1980 | Welch | |
| 4,617,690 | A | 10/1986 | Grebe | |
| 5,594,962 | A | 1/1997 | Bogdanoff | |
| 5,611,096 | A | 3/1997 | Bartlett et al. | |
| 5,647,079 | A | 7/1997 | Hakamium et al. | |
| 6,085,372 | A * | 7/2000 | James et al. | 5/713 |
| 6,119,292 | A * | 9/2000 | Haas | 5/715 |
| 6,353,950 | B1 | 3/2002 | Bartlett et al. | |
| 6,370,716 | B1 | 4/2002 | Wilkinson | |
| 6,467,111 | B1 | 10/2002 | Vrzalik et al. | |
| 6,523,198 | B1 | 2/2003 | Temple | |
| 6,725,485 | B2 * | 4/2004 | Hayes | 5/695 |
| 7,165,280 | B2 | 1/2007 | Wang | |
| 7,418,751 | B1 | 9/2008 | Bartlett et al. | |

(Continued)

FOREIGN PATENT DOCUMENTS

| | | |
|---|---|---|
| CN | 2198886 | 5/1995 |
| CN | 2580943 Y | 10/2003 |

(Continued)

OTHER PUBLICATIONS

European Search Authority, Extended European Search Report in related application No. 17205768.9 (dated Mar. 12, 2018).

*Primary Examiner* — Fredrick C Conley
(74) *Attorney, Agent, or Firm* — Fay Sharpe LLP

(57) ABSTRACT

A medical air mattress has a mattress body and an upper bedspread. The mattress body is formed by multiple air cells including independent air cells parallelly arranged as an air cell row. The upper bedspread covers the mattress body. The independent air cells are connected to the independent deflating unit to be deflated independently. When the patient needs to use the bedpan, the independent air cells are deflated to form a recess for receiving the bedpan so that the patient needs not to move.

46 Claims, 13 Drawing Sheets

(56) References Cited

U.S. PATENT DOCUMENTS

| | | | | |
|---|---|---|---|---|
| 2002/0194677 | A1 | 12/2002 | Hayes | |
| 2007/0094805 | A1 | 5/2007 | Davis | |
| 2007/0143928 | A1 | 6/2007 | Biggie et al. | |
| 2008/0178392 | A1 | 7/2008 | Chu | |
| 2009/0064418 | A1* | 3/2009 | Genaro et al. | 5/713 |
| 2010/0325796 | A1* | 12/2010 | Lachenbruch et al. | 5/423 |
| 2012/0011651 | A1 | 1/2012 | Moss | |
| 2012/0311783 | A1* | 12/2012 | Chiang et al. | 5/421 |

FOREIGN PATENT DOCUMENTS

| | | | |
|---|---|---|---|
| CN | 2601648 | Y | 2/2004 |
| CN | 2726583 | Y | 9/2005 |
| CN | 2850598 | Y | 12/2006 |
| CN | 2894675 | Y | 5/2007 |
| CN | 2920216 | Y | 7/2007 |
| CN | 201019949 | | 2/2008 |
| CN | 201049031 | Y | 4/2008 |
| CN | 201135566 | | 10/2008 |
| CN | 102525768 | | 7/2012 |
| CN | 103340724 | | 10/2013 |
| DE | 69801817 | | 4/2002 |
| GB | 2469540 | | 10/2010 |
| JP | 05228180 | | 9/1993 |
| JP | 06007733 | U | 2/1994 |
| JP | 07116199 | | 5/1995 |
| JP | 2001516241 | | 9/2001 |
| JP | 2002136560 | | 5/2002 |
| JP | 2007159981 | | 6/2007 |
| JP | 3168324 | U | 5/2011 |
| JP | 6050338 | | 12/2016 |
| RU | 2014101149 | | 7/2015 |
| TW | 545240 | | 8/2003 |
| TW | 552931 | | 9/2003 |
| TW | 574918 | | 2/2004 |
| TW | M248432 | | 11/2004 |
| TW | 201231034 | | 8/2012 |
| TW | 201231035 | | 8/2012 |
| WO | 0125835 | | 2/2002 |
| WO | 0238099 | | 5/2002 |

* cited by examiner

MEDICAL AIR MATTRESS

BACKGROUND OF THE INVENTION

1. Field of the Invention

The present invention relates to a medical air mattress, especially to a medical air mattress for anti-decubitus purposes.

2. Description of the Prior Arts

For patients who have physical difficulties with mobility or bedfast. Patients lying on a mattress over a long period of time are susceptible to develop decubitus ulcers on multiple areas of the body due to continuous pressure. In order to minimize or eliminate the development of decubitus ulcers caretakers must turn patient's body over or move the patient to alternate the areas of pressure on the body. The conventional medical air mattress was developed to assist in the manual movement of and alternating pressure areas on the patient using multiple odd and even cells alternatively inflated to generate wave motion for changing the contact areas of the patient's body. The conventional medical air mattress has the following inadequacies.

With reference to FIG. 12, because the patients lying on the conventional air mattress have difficulties with mobility or bedfast, patients need to use a bedpan 91 on the conventional air mattress. The conventional air mattress has several detachable air cells 90, which correspond to the position of the patient's hip. When the detachable air cells 90 are removed to form a recess, the bedpan 91 will be able to put into the recess for use. However, to prevent secondary infection and to be cleaned with ease, the conventional air mattress has an upper bedspread to cover on the air cells. Therefore, the upper bedspread needs to be removed before the detachable air cells 90 are removed. Removing the upper bedspread still requires the need to move the patient lying on the conventional air mattress. The design of detachable air cells 90 is inconvenient to caretakers since the patient still needs to leave the conventional air mattress. Furthermore, moving the patient and removing the upper bedspread requires two or more individuals. This is an inefficient use of time and human resources, and the detachable air cells 90 do not function as what the original design expected.

The present invention provides a medical air mattress to mitigate or obviate the aforementioned problems.

SUMMARY OF THE INVENTION

The main objective of the present invention is to provide independent air cells that can be deflated independently to receive the bedpan. The medical air mattress has a mattress body and an upper bedspread. The mattress body is formed by multiple air cells including independent air cells parallelly arranged as an air cell row. The upper bedspread covers the mattress body. The independent air cells are connected to the independent deflating unit to be deflated independently. When the patient needs to use the bedpan, the independent air cells are deflated to form a recess for receiving the bedpan so that the bedspread and the patient have no need to be moved.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
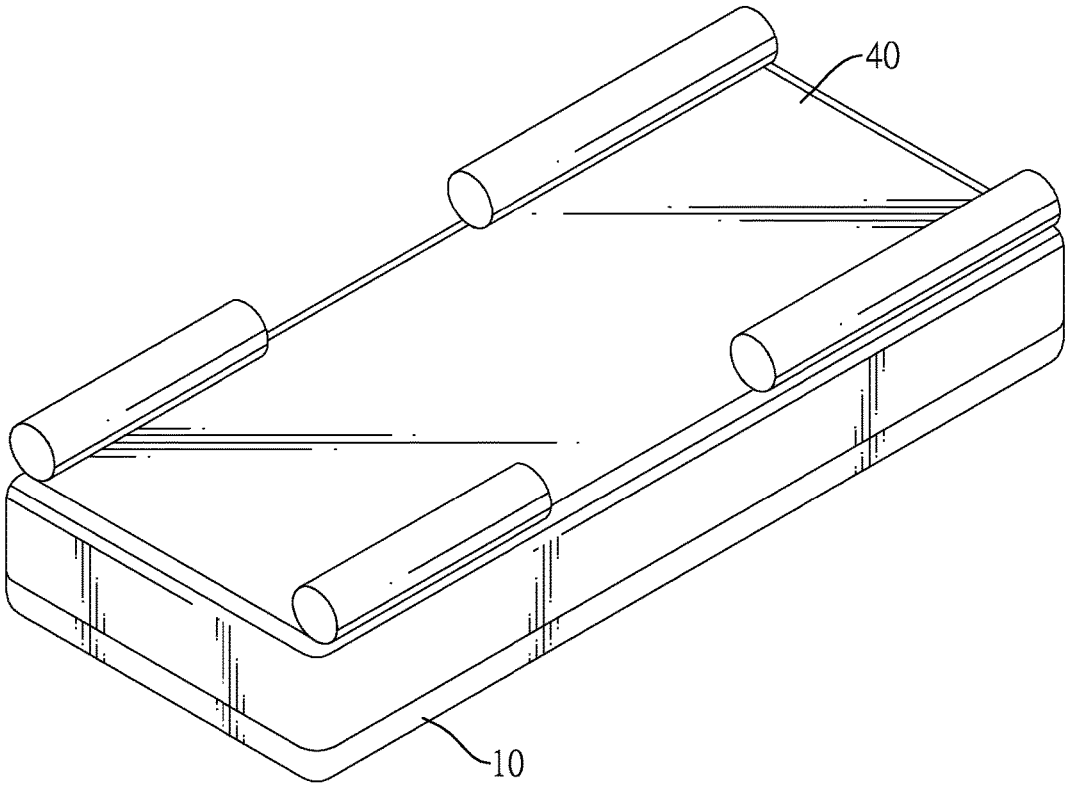
FIG. 1 is a perspective view of a medical air mattress in accordance with the present invention.
Figure 2:
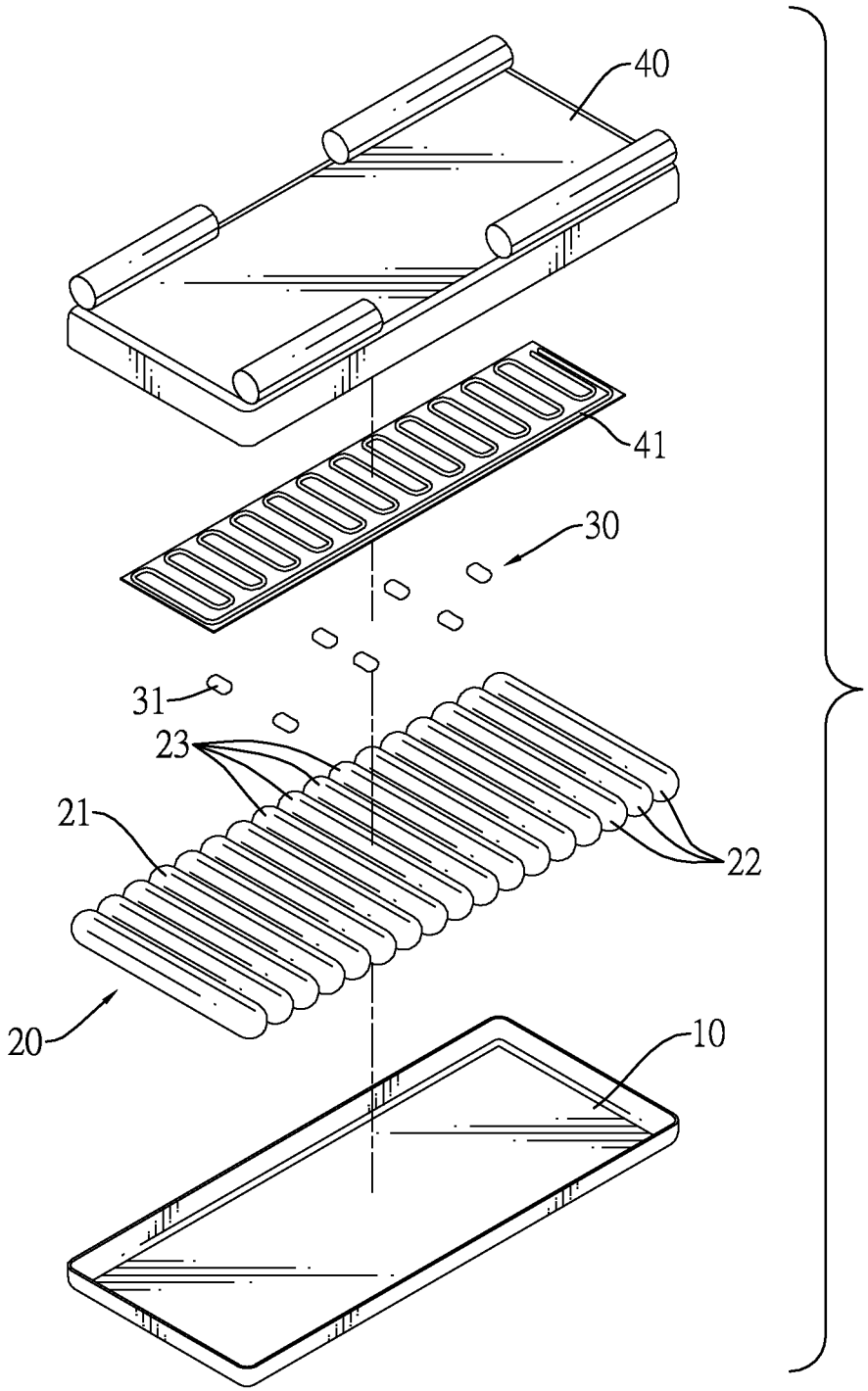
FIG. 2 is an exploded perspective view of the medical air mattress in FIG. 1.

With reference to FIGS. 1 and 2, a first embodiment of a medical air mattress in accordance with the present invention comprises a lower bedspread 10, a mattress body 20 and an upper bedspread 40.

The mattress body 20 is mounted on the lower bedspread 10 and comprises multiple body air cells 21, multiple head air cells 22 and multiple independent air cells 23. In a preferred embodiment, the mattress body 20 comprises three head air cells 22 and four independent air cells 23. Each body air cell 21, each head air cell 22, and the independent air cells 23 are tubular and respectively uniform in diameter. The body air cells 21, the head air cells 22 and the independent air cells 23 are parallel to each other and are arranged in a row to form an air cell row. The head air cells 22 are arranged at a head end in the air cell row, i.e. the head air cells 22 arranged at first to third in the air cell row. The independent air cells 23 are arranged at a central part in the air cell row, i.e. the independent air cells 23 are arranged at seventh to tenth in the air cell row. The body air cells 21 are arranged at fourth to sixth and eleventh to seventeenth in the air cell row.

The upper bedspread 40 covers the mattress body 20 and is connected securely to the lower bedspread 10. A heat unit 41 is attached under the upper bedspread 40 for heating. The heat unit 41 may be carbon fiber electrothermal sheet.

The medical air mattress as described further comprises a massage unit 30 mounted above the mattress body 20. The massage unit 30 comprises multiple micro vibrators 31 to massage the patients lying on the medical air mattress as described. Those micro vibrators 31 distribute massage separately and respectively to patient's neck, back, waist, thighs and so on.

Figure 3:
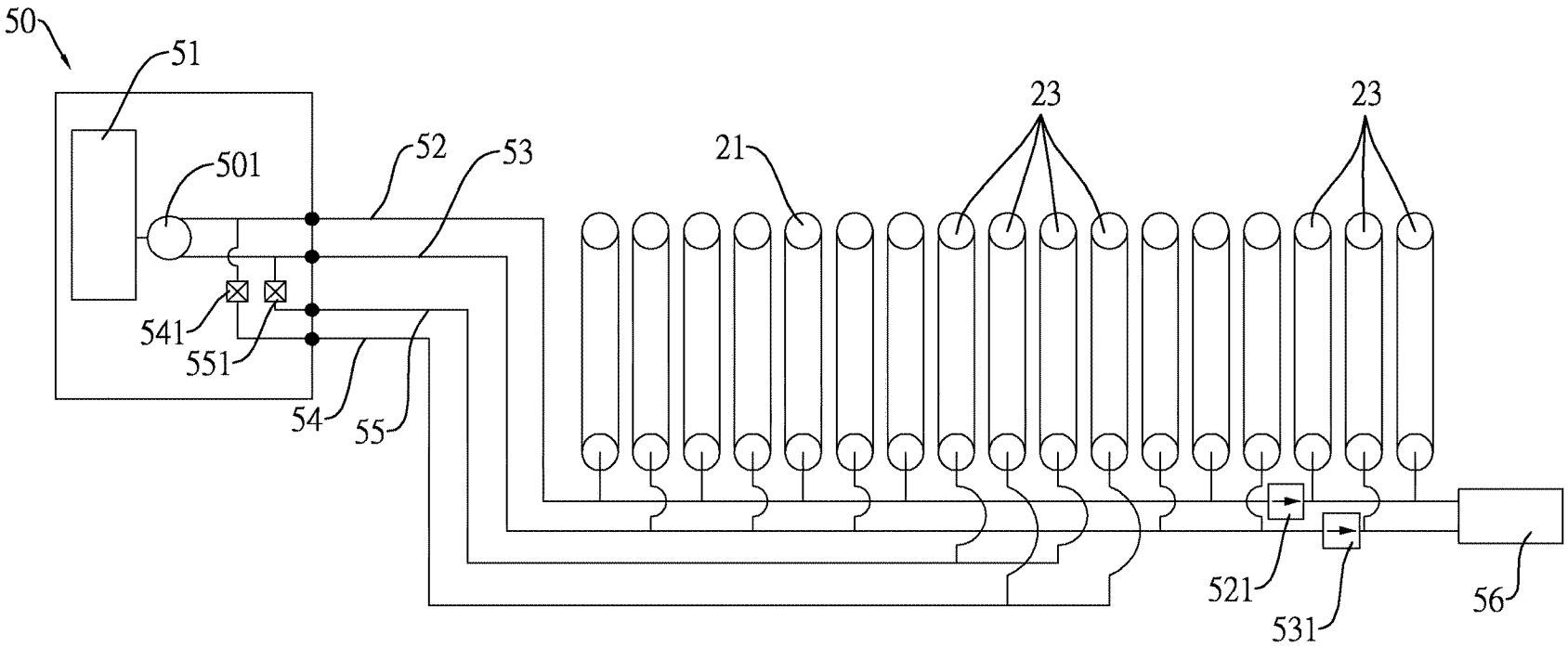
FIG. 3 is a pipeline diagram of the medical air mattress in FIG. 1.

With reference to FIG. 3, the medical air mattress as described comprises a pumping assembly 50. The pumping assembly 50 is connected to and selectively inflates the body air cells 21, the head air cells 22 and the independent air cells 23. In a preferred embodiment, the pumping assembly 50 comprises a pump 51, an odd body pipeline 52, an even body pipeline 53, an odd independent pipeline 54, an even independent pipeline 55 and a rapidly releasing valve 56. The odd body pipeline 52 connects the pump 51 with the odd body air cells 21 and the head air cells 22 at odd rows of the air cell rows. The even body pipeline 53 connects the pump 51 with the even body air cells 21 and the head air cells 22 at even rows of the air cell rows. The odd independent pipeline 54 connects the pump 51 with the independent air cells 23 at odd rows of the air cell rows. The even independent pipeline 55 connects the pump 51 with the independent air cells 23 at even rows of the air cell rows. The rapidly releasing valve 56 is connected to the odd body pipeline 52 and the even body pipeline 53 for rapidly releasing the air in the mattress body 20 for emergency use. For example, when the patient needs C.P.R., the medical air mattress as described needs not be removed or the patient needs not be moved since the mattress body 20 is rapidly deflated to rescue the patient immediately.

In a preferred embodiment, the pump 51 is connected to a body alternating-valve 501. The body alternating-valve 501 is connected between the pump 51 and the body pipelines 52, 53 and the independent pipelines 54, 55 The independent air cells 23 are connected to an independent deflating unit to be deflated independently. The independent deflating unit comprises an odd solenoid valve 541 and an even solenoid valve 551. The odd and even solenoid valves 541, 551 are three-way valves and respectively have deflating opening to the exterior so that the independent air cells 23 are selectively deflated independently via the odd and even solenoid valves 541, 551. The odd independent pipeline 54 is connected to the pump 51 via the odd body pipeline 52. The even independent pipeline 55 is connected to the pump 51 via the even body pipeline 53. In a preferred embodiment, the odd independent pipeline 54 is connected to the odd body pipeline 52 via the odd independent solenoid valve 541, and the even independent pipeline 55 is connected to the even body pipeline 53 via the even independent solenoid valve 551. The odd body pipeline 52 is connected to the head air cells 22 via a first check valve 521. The even body pipeline 53 is connected to the head air cells 22 via a second check valve 531.

Figure 3A:
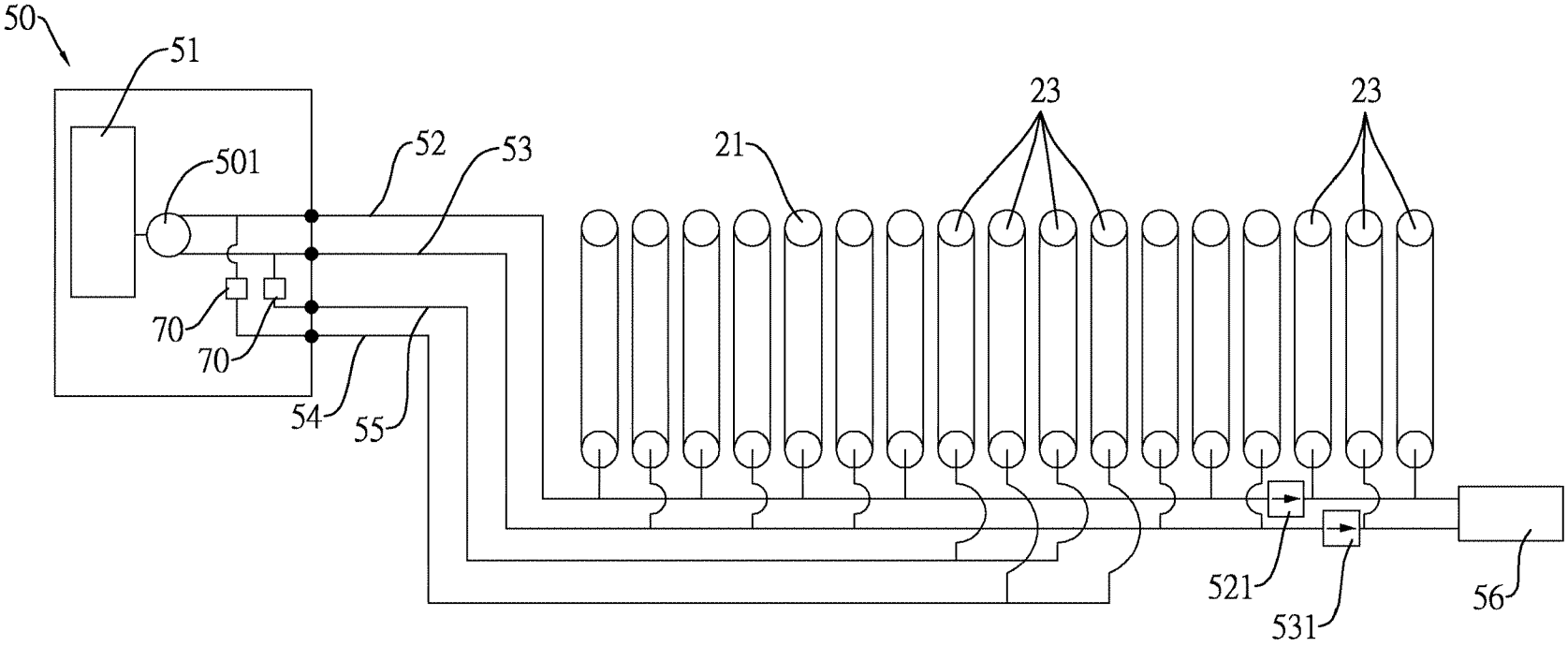
FIG. 3A is a pipeline diagram of the medical air mattress in FIG. 1.

With reference to FIG. 3A, the independent deflating unit for the independent air cells 23 may be a manual alternating device 70. The user controls the manual alternating device 70 to stop inflating the independent air cells 23. The manual alternating device 70 has an air inlet, an inflating opening, a deflating opening, a linking rod, two airflow washers, an air restricting washer and a resilient element. The air inlet is connected to the body alternating-valve 501. The inflating opening is connected to the independent air cells 23 through the independent pipelines 54, 55. The deflating opening communicates with the exterior. When inflating, the deflating opening is closed and the inflating opening is opened to inflate the independent air cells 23. When deflating, the resilient element, the linking rod and the air-resisting washer are manually moved to close the inflating opening and to open the deflating opening. Then the independent air cells 23 are deflated independently.

When the medical air mattress as described is operated, the pump 51, the alternating-valves 501 and the solenoid valves 541,551 are actuated to inflate the air cells and to alternatively adjust the inflating. The inflating and the deflating operations are described detailedly below.

For the mattress body, when the pump 51 is operated, user may select different modes.

Figure 4:
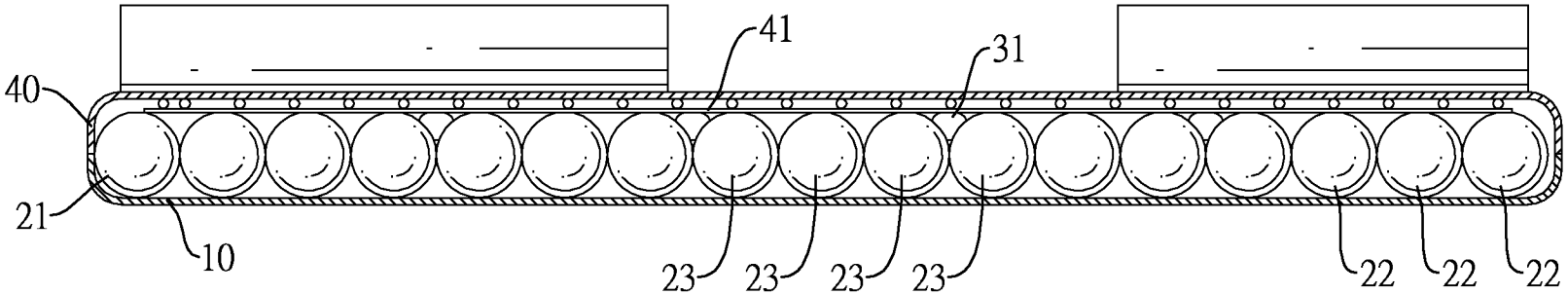
FIG. 4 is an operational side view in partial section of the medical air mattress in FIG. 1, showing the body air cells all inflated.

1. Full inflating mode:

With reference to FIGS. 3 and 4, the pump 51 is operated to inflate the body air cells 21, the head air cells 22 and the independent air cells 23.

Figure 5:
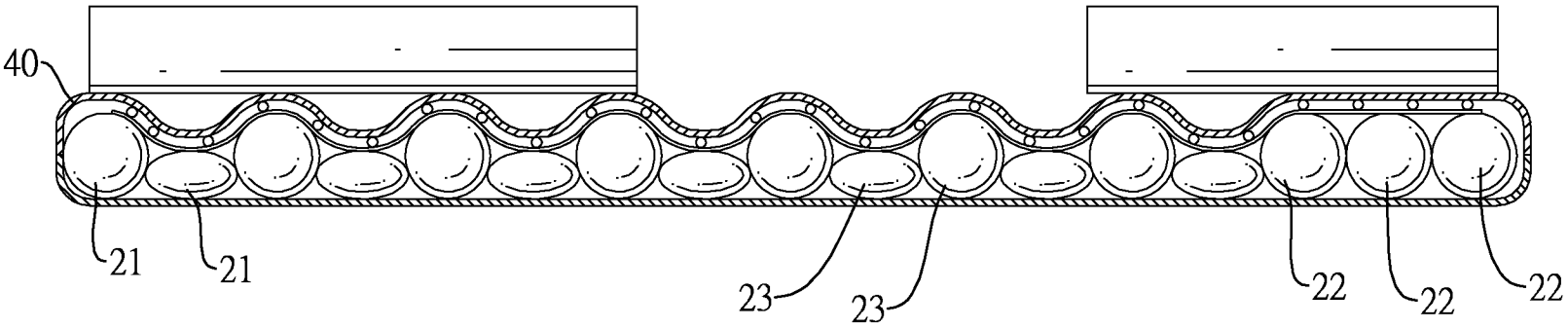
FIG. 5 is an operational side view in partial section of the medical air mattress in FIG. 1, showing the odd body air cells inflated.
Figure 6:
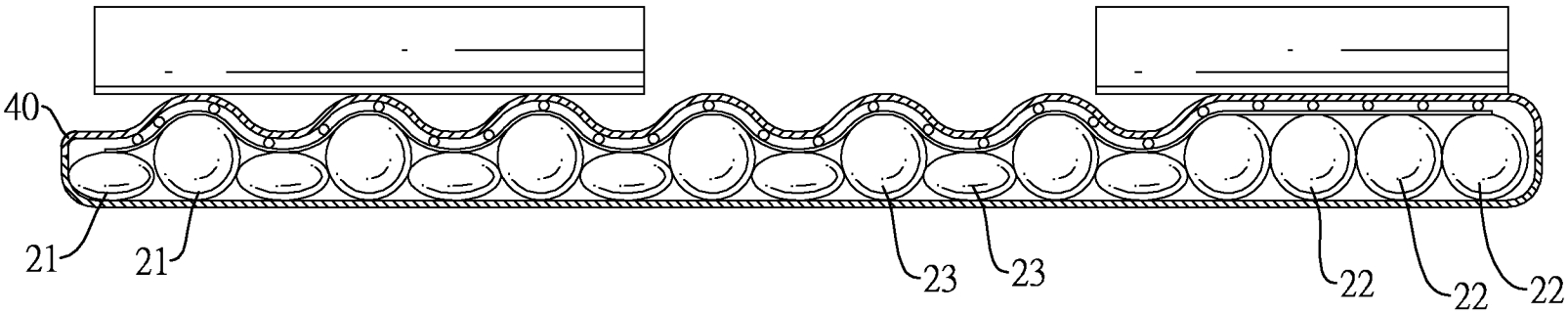
FIG. 6 is an operational side view in partial section of the medical air mattress in FIG. 1, showing the even body air cells inflated.

2. Alternating inflating mode:

With reference to FIGS. 3, 5 and 6, the pump 51 is operated and inflates the body air cells 21 and the independent air cells 23 at odd or even rows of the air cell rows alternatively. In a preferred embodiment, the body alternating-valve 501 accomplishes the alternating inflating. The pump 51 supplies air into the body alternating-valve 501. The body alternating-valve 501 alternatively supplies air into the odd or even body pipelines 52, 53. When the odd body pipeline 52 is inflated, the body air cells 21 and the independent air cells 23 at odd rows of the air cell rows are inflated and the body air cells 21 and the independent air cells 23 at even rows of the air cell rows are deflated as shown in FIG. 5. When the even body pipeline 53 is inflated, the body air cells 21 and the independent air cells 23 at even rows of the air cell rows are inflated and the body air cells 21 and the independent air cells 23 at odd rows of the air cell rows are deflated as shown in FIG. 6. Moreover, since the check valves 521, 531 are connected between the head air cells 22, the odd and even body pipelines 52, 53, the head air cells 22 are kept inflated without deflating by the body alternating-valve 501 to support the patient's head stably.

Figure 7:
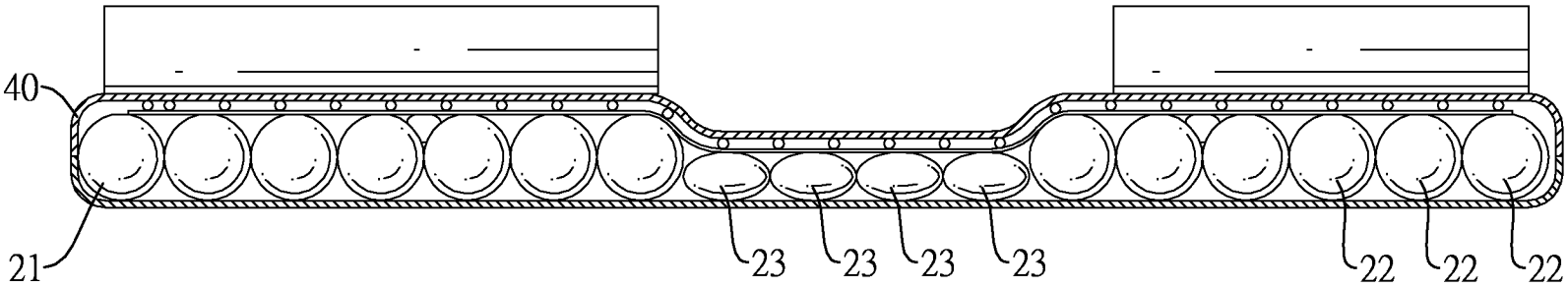
FIG. 7 is an operational end view in partial section of the medical air mattress in FIG. 1, showing the independent air cells deflated.

For the independent air cells 23 as shown in FIGS. 3 and 7, the user may stop inflating the independent air cells 23 independently. In a preferred embodiment, the odd solenoid valve 541 and the even solenoid valve 551 are used to stop inflating the independent air cells 23. Each solenoid valve 541, 551 has an air inlet, an inflating opening and a deflating opening. The air inlet is connected to the body alternating-valve 501. The inflating opening is connected to the independent air cells 23 via through the independent pipelines 54, 55. The deflating opening is connected to the exterior. When the independent air cells 23 are inflated, the deflating opening is closed and the inflating opening is opened. When the independent air cells 23 are deflated independently, the inflating opening is closed and the deflating opening is opened. The central part of the upper bedspread 40 corresponding to the independent air cells 23 is not supported when the independent air cells 23 are deflated. The central part of the upper bedspread 40 is recessed to form a room for receiving the bedpan. Therefore, the patient lying on the medical air mattress as described does not have to move and can use the bedpan while lying on the medical air mattress as described.

Figure 8:
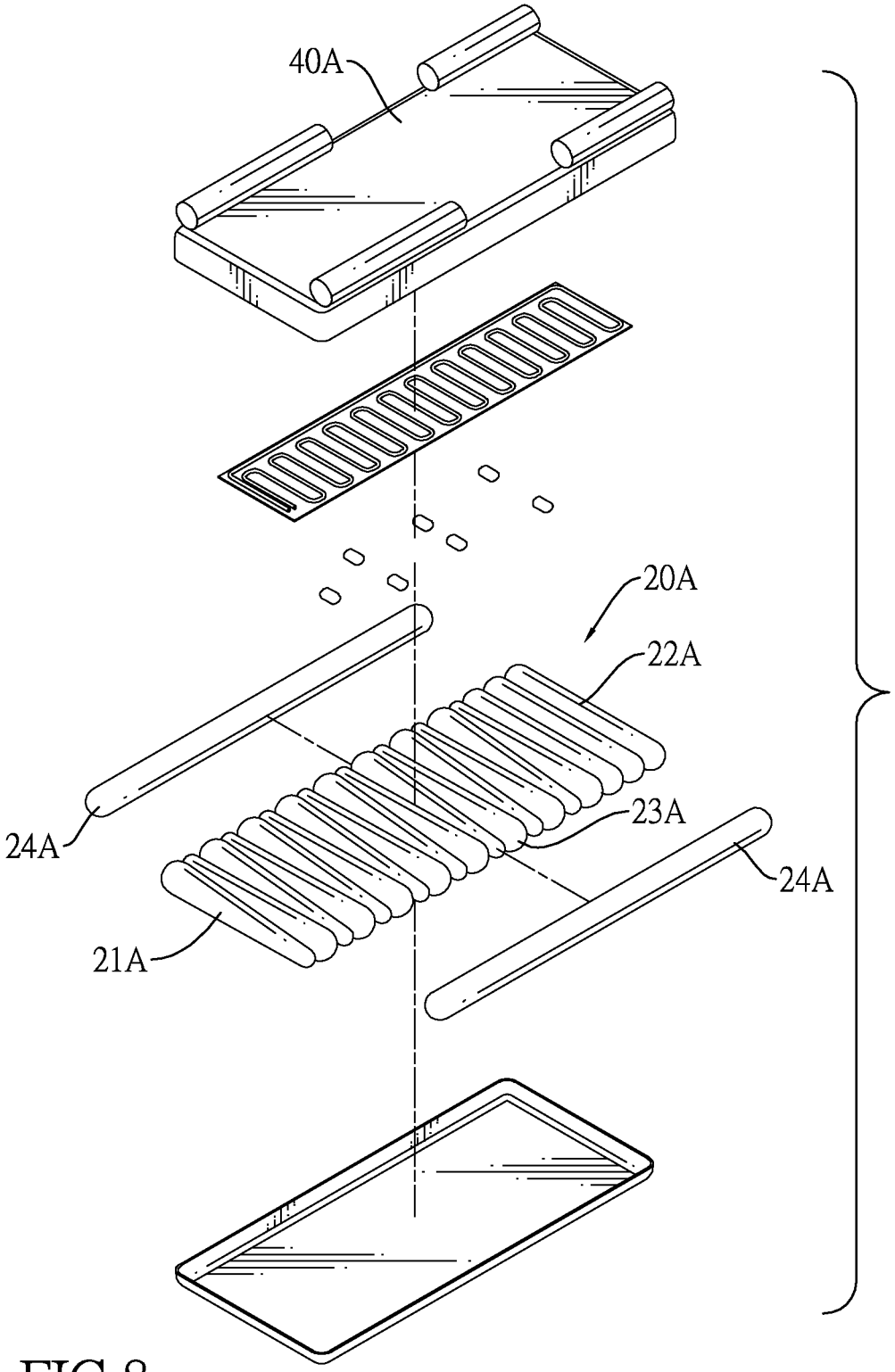
FIG. 8 is an exploded perspective view of another embodiment of a medical air mattress in accordance with the present invention.
Figure 9:
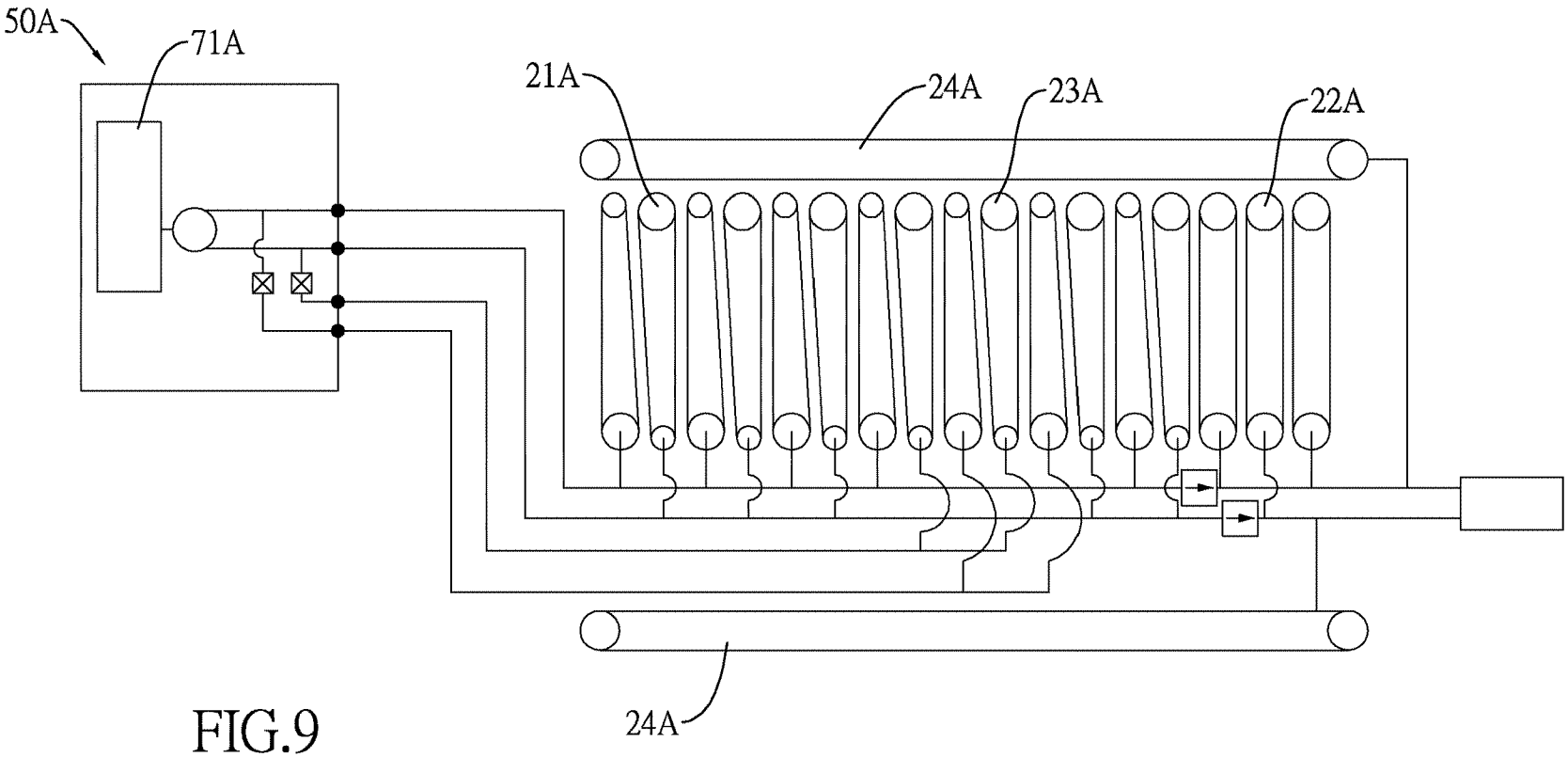
FIG. 9 is a pipeline diagram of the medical air mattress in FIG. 8.

With reference to FIGS. 8 and 9, a second embodiment of a medical air mattress in accordance with the present invention is similar to the first embodiment as described, but the body air cells 21A and the independent air cells 23A of the body mattress 20A are conical. Each body air cell 21A and each independent air cell 23A gradually tapers in diameter from one end to the other end so that each body air cell 21A and each independent air cell 23A has a wide end and a narrow end. The body air cells 21A and the independent air cells 23A are arranged with wide ends adjacent to the narrow ends. For example, the wide ends of the body air cells 21A and the independent air cells 23A at odd rows of the air cell rows align with the narrow ends of the body air cells 21A and the independent air cells 23A at even rows of the air cell rows. The medical air mattress as described further comprises two offset air cells 24A mounted longitudinally and mounted respectively on two sides of the mattress body 20A to enlarge the area of the medical air mattress and to support the upper bedspread 40A. The offset air cells 24A are connected to the pipeline connecting to the head air cells 22A and are also protected by the check valve to maintain inflating.

When the medical air mattress as described is operated, the pump 51A, the alternating-valves and the solenoid valves are also actuated to inflate the air cells and to alternatively adjust the inflating. Since most operations are discussed above, only different operations are described below for the second embodiment of the medical air mattress.

For mattress body 20A, when the pump 51A is operated, user may select different modes.

1. Full inflating mode:

The pump 51A is operated to inflate the body air cells 21A, the head air cells 22A and the independent air cells 23A.

Figure 10:
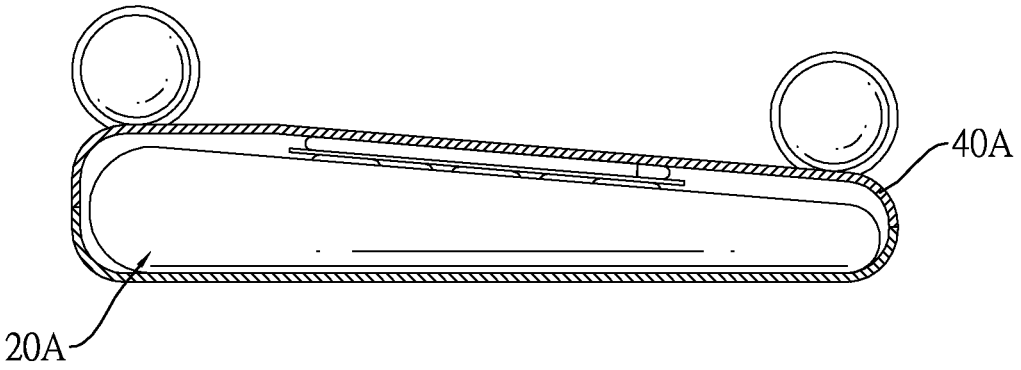
FIG. 10 is an operational end view in partial section of the medical air mattress in FIG. 8, showing the odd body air cells inflated.
Figure 11:
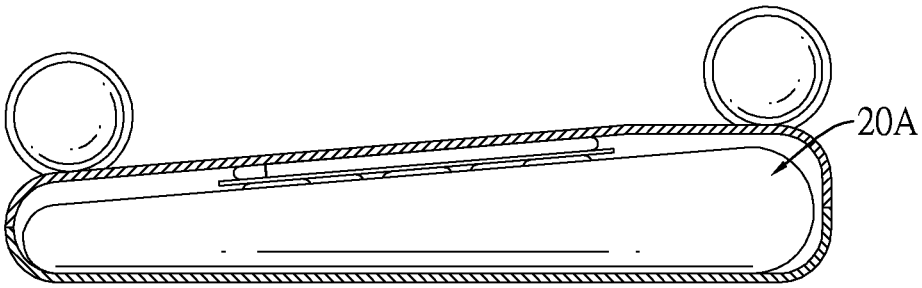
FIG. 11 is an operational end view in partial section of the medical air mattress in FIG. 8, showing the even body air cells inflated.
Figure 12:
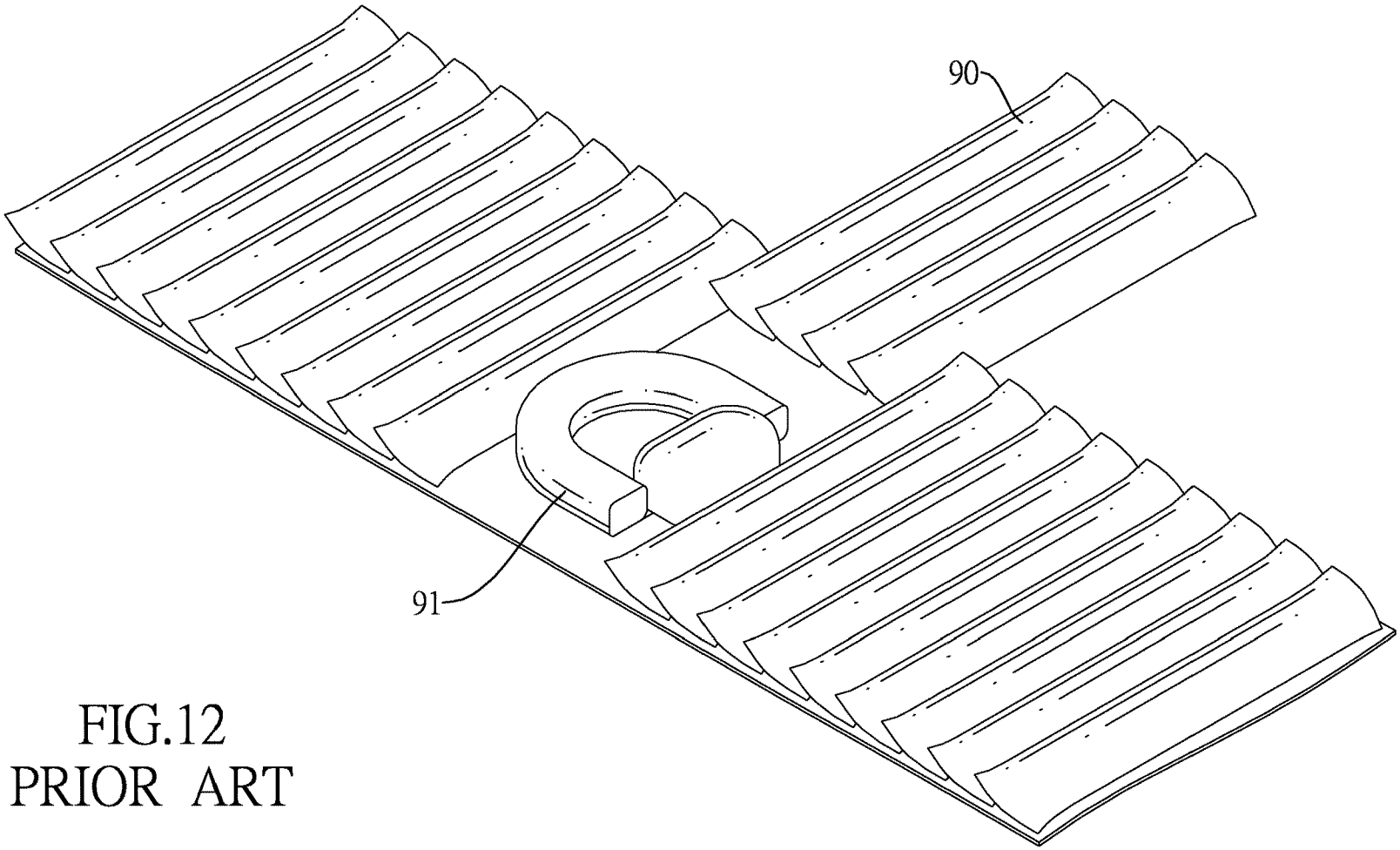
FIG.12 PRIOR ART
FIG. 12 is perspective view of a conventional medical air mattress in accordance with the prior art with a bedpan.

2. Alternating inflating mode:

With reference to FIGS. 9 to 11, the pump 51A is operated and inflates the body air cells 21A and the independent air cells 23A at either odd or even rows of the air cell rows alternatively. When the body air cells 21A and the independent air cells 23A at odd rows of the air cell rows are inflated, the body air cells 21A and the independent air cells 23A at even rows of the air cell rows are deflated as shown in FIG. 10. Since the body air cells 21A and the independent air cells 23A at odd rows of the air cell rows have wide left ends and narrow right ends, the mattress body 20A is higher at left side and lower at right side to tilt the patient rightward. When the body air cells 21A and the independent air cells 23A at even rows of the air cell rows are inflated, the body air cells 21A and the independent air cells 23A at odd rows of the air cell rows are deflated as shown in FIG. 11. Since the body air cells 21A and the independent air cells 23A at even rows of the air cell rows have wide right ends and narrow left ends, the mattress body 20A is higher at right side and lower at left side to tilt the patient leftward. Therefore, the alternating inflating of the body air cells 21A and the independent air cells 23A not only provides the alternating wave of the mattress body 20A, but also tilts the patient at a certain angle. In this embodiment, the body air cells 21A and the independent air cells 23A provides inclined angle at, said 20 degrees.

Even though numerous characteristics and advantages of the present invention have been set forth in the foregoing description, together with details of the structure and features of the invention, the above disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are configured to be inflatable and deflatable, the multiple independent air cells are arranged at a central part of the mattress body and are configured to be inflatable and deflatable, the multiple body air cells are configured to be inflatable and deflatable, at least two of the independent air cells that are positioned adjacent to one another are positioned between two of the body air cells or between one of the body air cells and one of the head air cells;

a pumping assembly connecting to the mattress body and comprising:

a pump, a body pipeline that connects the pump with the body air cells and the head air cells, an independent pipeline that connects the pump with the independent air cells, the independent pipeline is connected to the pump via the body pipeline, an independent deflating unit connecting the independent pipeline to the body pipeline, the independent deflating unit is configured for selectively deflating the independent air cells, wherein the pump supplies fluid to the body pipeline to inflate the body air cells and the head air cells, the body pipeline supplies fluid to the independent pipeline to inflate the independent air cells;

wherein the independent deflating unit is operative to deflate the independent air cells while the body pipeline maintains inflation of the odd and/or even body air cells and the head air cells; and an upper bedspread covering the mattress body and connected securely to the lower bedspread, characterized in that the multiple independent air cells are inflatable and/or deflatable independently of the body air cells, the multiple body air cells are inflatable and deflatable independently of the head air cells, the central part of the mattress body is configured to receive a bedpan when the multiple independent air cells are deflated.

2. The medical air mattress as claimed in claim 1, wherein each body air cell, each head air cell and each independent air cell are respectively uniform in diameter between a width of the mattress body when said air cells are inflated, a length of each of said air cells extends a full width of the mattress body.

3. The medical air mattress as claimed in claim 2, wherein the pumping assembly further comprising:

an odd body pipeline connecting the pump with the body air cells and the head air cells at odd rows of the air cell rows to provide fluid flow to and/or from the body air cells and head air cells to inflate and/or deflate the body air cells and head air cells;

an even body pipeline connecting the pump with the body air cells and the head air cells at even rows of the air cell rows to provide fluid flow to and/or from the body air cells and head air cells to inflate and/or deflate the body air cells and head air cells;

an odd independent pipeline connecting the pump, the odd body pipeline, or combinations thereof with the independent air cells at odd rows of the air cell rows to provide flow to and/or from to the independent air cells to inflate and/or deflate the independent air cells; and an even independent pipeline connecting the pump, the even body pipeline, or combinations thereof with the independent air cells at even rows of the air cell rows to provide fluid to the independent air cells to inflate and/or deflate the independent air cells.

4. The medical air mattress as claimed in claim 3, further comprising: a rapidly releasing valve connected to the odd body pipeline and the even body pipeline.

5. The medical air mattress as claimed in claim 2, further comprising a massage unit mounted on the mattress body and having multiple micro vibrators.

6. The medical air mattress as claimed in claim 2, further comprising a heat unit made of carbon fiber electrothermal sheet and attached under the upper bedspread.

7. The medical air mattress as claimed in claim 1, further comprising a massage unit mounted on the mattress body and having multiple micro vibrators.

8. The medical air mattress as claimed in claim 1, further comprising a heat unit made of carbon fiber electrothermal sheet and attached under the upper bedspread.

9. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are configured to be inflatable and deflatable, the multiple independent air cells are arranged at a central part of the mattress body and are configured to be inflatable and deflatable, the multiple body air cells are configured to be inflatable and deflatable, at least two of the independent air cells that are positioned adjacent to one another are positioned between two of the body air cells or between one of the body air cells and one of the head air cells;

a pumping assembly connecting to the mattress body and comprising an independent deflating unit connecting to the independent air cells, the pumping assembly is configured to selectively inflate and/or deflate the multiple body air cells, the multiple head air cells and the multiple independent air cells; and an upper bedspread covering the mattress body and connected securely to the lower bedspread, characterized in that the multiple independent air cells are inflatable and/or deflatable independently of the body air cells, the multiple body air cells are inflatable and/or deflatable independently of the head air cells, the mattress body is configured to receive a bedpan when the multiple independent air cells are deflated;

wherein each body air cell, each head air cell and each independent air cell are respectively uniform in diameter between a width of the mattress body when said air cells are inflated, a length of each of said air cells extends a full width of the mattress body;

wherein the pumping assembly comprising:

a pump;

an odd body pipeline connecting the pump with the body air cells and the head air cells at odd rows of the air cell rows to provide fluid flow to and/or from the body air cells and head air cells to inflate and/or deflate the body air cells and head air cells;

an even body pipeline connecting the pump with the body air cells and the head air cells at even rows of the air cell rows to provide fluid flow to and/or from the body air cells and head air cells to inflate and/or deflate the body air cells and head air cells;

an odd independent pipeline connecting the pump, the odd body pipeline, or combinations thereof with the independent air cells at odd rows of the air cell rows to provide fluid flow to and/or from the independent air cells to inflate and/or deflate the independent air cells; and an even independent pipeline connecting the pump, the even body pipeline, or combinations thereof with the independent air cells at even rows of the air cell rows to provide fluid flow to and/or from the independent air cells to inflate and/or deflate the independent air cells;

wherein the independent deflating unit comprises an odd solenoid valve and an even solenoid valve respectively having a deflating opening so that the independent air cells are selectively deflated independently via the odd and even solenoid valves;

the odd independent pipeline is connected to the odd body pipeline via the odd independent solenoid valve such that the odd independent solenoid valve is positioned between and controls air flow between the pump and the odd independent pipeline; and the even independent pipeline is connected to the even body pipeline via the even independent solenoid valve such that the even independent solenoid valve is positioned between and controls air flow between the pump and the even independent pipeline; and the pumping assembly further comprises:

a body alternating-valve connected between the pump with the body pipelines and the independent pipelines for alternatively supplying air into the odd or even pipelines;

a first check valve connected between the odd body pipeline and the odd head air cells, the first check valve for keeping the odd head air cells inflated when the body-alternating valve is operative to deflate the body air cells at the odd rows; and a second check valve connected between the even body pipeline and the even head air cells, the second check valve for keeping the even head air cells inflated when the body-alternating valve is operative to deflate the body air cells at the even rows.

10. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are designed to be inflatable and deflatable, the multiple independent air cells are arranged at a central part of the mattress body and are designed to be inflatable and deflatable, the multiple body air cells are designed to be inflatable and deflatable, the independent air cells are designed to be deflatable, at least one of the independent air cells is positioned between two of the body air cells or between one of the body air cells and one of the head air cells;

a pumping assembly connecting to the mattress body and comprising an independent deflating unit connecting to the independent air cells, the pumping assembly is configured to selectively inflate and deflate the multiple body air cells, the multiple head air cells and the multiple independent air cells; and an upper bedspread covering the mattress body and connected securely to the lower bedspread, characterized in that the multiple independent air cells are inflatable and deflatable independently of the body air cells and the head air cells, the multiple body air cells are inflatable and deflatable independently of the head air cells, the mattress body is designed to receive a bedpan when the multiple independent air cells are deflated;

wherein each body air cell gradually tapers in diameter along the complete longitudinal length of the body air cell from a wide end to a narrow end; and each independent air cell gradually tapers in diameter along the complete longitudinal length of the independent air cell from a wide end to a narrow end;

wherein the body air cells and the independent air cells are arranged with wide ends adjacent to the narrow ends;

wherein the pumping assembly comprising:

a pump;

an odd body pipeline connecting the pump with the body air cells and the head air cells at odd rows of the air cell rows to provide fluid to the body air cells and head air cells to inflate and deflate the body air cells and head air cells;

an even body pipeline connecting the pump with the body air cells and the head air cells at even rows of the air cell rows to provide fluid to the body air cells and head air cells to inflate and deflate the body air cells and head air cells;

an odd independent pipeline connecting the pump, the odd body pipeline, or combinations thereof with the independent air cells at odd rows of the air cell rows to provide fluid to the independent air cells to inflate and deflate the independent air cells; and an even independent pipeline connecting the pump, the even body pipeline, or combinations thereof with the independent air cells at even rows of the air cell rows to provide fluid to the independent air cells to inflate and deflate the independent air cells;

wherein the independent deflating unit comprises an odd solenoid valve and an even solenoid valve respectively having deflating opening to the exterior so that the independent air cells are selectively deflated independently via the odd and even solenoid valves;

the odd independent pipeline is connected to the odd body pipeline via the odd independent solenoid valve such that the odd independent solenoid valve is positioned between and controls air flow between the pump and the odd independent pipeline; and the even independent pipeline is connected to the even body pipeline via the even independent solenoid valve such that the even independent solenoid valve is positioned between and controls air flow between the pump and the even independent pipeline; and the pumping assembly comprises:

a body alternating-valve connected between the pump with the body pipelines and the independent pipelines;

a first check valve connected between the odd body pipeline and the odd head air cells; and a second check valve connected between the even body pipeline and the even head air cells.

11. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are configured to be inflatable and deflatable, the multiple independent air cells are arranged at a central part of the mattress body and are configured to be inflatable and deflatable, the multiple body air cells are configured to be inflatable and deflatable, at least two of the independent air cells that are positioned adjacent to one another are positioned between two of the body air cells or between one of the body air cells and one of the head air cells;

a pumping assembly connecting to the mattress body and comprising an independent deflating unit connecting to the independent air cells, the pumping assembly is configured to selectively inflate and/or deflate the multiple body air cells, the multiple head air cells and the multiple independent air cells; and an upper bedspread covering the mattress body and connected securely to the lower bedspread, characterized in that the multiple independent air cells are inflatable and/or deflatable independently of the body air cells, the multiple body air cells are inflatable and/or deflatable independently of the head air cells, the central part of the mattress body is configured to receive a bedpan when the multiple independent air cells are deflated;

wherein the pumping assembly comprising:

a pump;

an odd body pipeline connecting the pump with the body air cells and the head air cells at odd rows of the air cell rows to provide fluid flow to and/or from the body air cells and head air cells to inflate and/or deflate the body air cells and head air cells;

an even body pipeline connecting the pump with the body air cells and the head air cells at even rows of the air cell rows to provide fluid flow to and/or from the body air cells and head air cells to inflate and/or deflate the body air cells and head air cells;

an odd independent pipeline connecting the odd body pipeline with the independent air cells at odd rows of the air cell rows to provide fluid flow to and/or from the independent air cells to inflate and/or deflate the independent air cells; and an even independent pipeline connecting the even body pipeline thereof with the independent air cells at even rows of the air cell rows to provide fluid flow to and/or from the independent air cells to inflate and/or deflate the independent air cells;

wherein the independent deflating unit comprises an odd solenoid valve and an even solenoid valve respectively having a deflating opening so that the independent air cells are selectively deflated independently via the odd and even solenoid valves;

the odd independent pipeline is connected to the odd body pipeline via the odd independent solenoid valve such that the odd independent solenoid valve is positioned between and controls air flow between the pump and the odd independent pipeline; and the even independent pipeline is connected to the even body pipeline via the even independent solenoid valve such that the even independent solenoid valve is positioned between and controls air flow between the pump and the even independent pipeline; and the pumping assembly further comprises:

a body alternating-valve connected between the pump with the body pipelines, the body alternating-valve alternatively supplying air into one of the odd and even body pipelines;

a first check valve connected between the odd body pipeline and the odd head air cells, the first check valve operative to keep the head air cells at odd rows inflated when the body-alternating valve is actuated to supply air to the even-body pipeline; and a second check valve connected between the even body pipeline and the even head air cells, the second check valve operative to keep the head air cells at even rows inflated when the body-alternating valve is actuated to supply air to the odd body pipeline.

12. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are designed to be inflatable and deflatable, the multiple independent air cells are arranged at a central part of the mattress body and are designed to be inflatable and deflatable, the independent air cells are designed to be inflatable and deflatable, at least one of the independent air cells is positioned between two of the body air cells or between one of the body air cells and one of the head air cells; each body air cell gradually tapers in diameter along the complete longitudinal length of the body air cell from a wide end to a narrow end; and each independent air cell gradually tapers in diameter along the complete longitudinal length of the independent air cell from a wide end to a narrow end;

a pumping assembly connecting to the mattress body and comprising an independent deflating unit connecting to the multiple independent air cells; and an upper bedspread covering the mattress body and connected securely to the lower bedspread, characterized in that the multiple independent air cells are deflatable independently of the body air cells and the head air cells, the mattress body is designed to receive a bedpan when the multiple independent air cells are deflated.

13. The medical air mattress as claimed in claim 12, wherein the body air cells and the independent air cells are arranged with wide ends adjacent to the narrow ends.

14. The medical air mattress as claimed in claim 13, wherein the pumping assembly further comprising:

an odd body pipeline connecting the pump with the body air cells and the head air cells at odd rows of the air cell rows to provide fluid flow to and/or from the body air cells and head air cells to inflate and/or deflate the body air cells and head air cells;

an even body pipeline connecting the pump with the body air cells and the head air cells at even rows of the air cell rows to provide fluid flow to and/or from the body air cells and head air cells to inflate and/or deflate the body air cells and head air cells;

an odd independent pipeline connecting the pump, the odd body pipeline, or combinations thereof with the independent air cells at odd rows of the air cell rows to provide flow to and/or from to the independent air cells to inflate and/or deflate the independent air cells; and an even independent pipeline connecting the pump, the even body pipeline, or combinations thereof with the independent air cells at even rows of the air cell rows to provide fluid to the independent air cells to inflate and/or deflate the independent air cells.

15. The medical air mattress as claimed in claim 13, wherein the pumping assembly comprising:

a pump;

an odd body pipeline connecting the pump with the body air cells and the head air cells at odd rows of the air cell rows to provide fluid to the body air cells and head air cells to inflate and deflate the body air cells and head air cells;

an even body pipeline connecting the pump with the body air cells and the head air cells at even rows of the air cell rows to provide fluid to the body air cells and head air cells to inflate and deflate the body air cells and head air cells;

an odd independent pipeline connecting the pump, the odd body pipeline, or combinations thereof with the independent air cells at odd rows of the air cell rows to provide fluid to the independent air cells to inflate and deflate the independent air cells; and an even independent pipeline connecting the pump, the even body pipeline, or combinations thereof with the independent air cells at even rows of the air cell rows to provide fluid to the independent air cells to inflate and deflate the independent air cells.

16. The medical air mattress as claimed in claim 13, further comprising a heat unit made of carbon fiber electrothermal sheet and attached under the upper bedspread.

17. The medical air mattress as claimed in claim 13, further comprising a massage unit mounted on the mattress body and having multiple micro vibrators.

18. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are configured to be inflatable and deflatable, the multiple independent air cells are arranged at a central part of the mattress body and are configured to be inflatable and deflatable, the multiple body air cells are configured to be inflatable and deflatable, at least two of the independent air cells that are positioned adjacent to one another are positioned between two of the body air cells or between one of the body air cells and one of the head air cells;

a pumping assembly connecting to the mattress body and comprising an independent deflating unit connecting to the independent air cells, the pumping assembly is configured to selectively inflate and/or deflate the multiple body air cells, the multiple head air cells and the multiple independent air cells; and an upper bedspread covering the mattress body and connected securely to the lower bedspread, characterized in that the multiple independent air cells are inflatable and/or deflatable independently of the body air cells, the multiple body air cells are inflatable and/or deflatable independently of the head air cells, the mattress body is configured to receive a bedpan when the multiple independent air cells are deflated;

wherein each body air cell, each head air cell and each independent air cell are respectively uniform in diameter between a width of the mattress body when said air cells are inflated, a length of each of said air cells extends a full width of the mattress body;

wherein the pumping assembly comprising:

a pump;

an odd body pipeline connecting the pump with the body air cells and the head air cells at odd rows of the air cell rows to provide fluid flow to and/or from the body air cells and head air cells to inflate and/or deflate the body air cells and head air cells;

an even body pipeline connecting the pump with the body air cells and the head air cells at even rows of the air cell rows to provide fluid flow to and/or from the body air cells and head air cells to inflate and/or deflate the body air cells and head air cells;

an odd independent pipeline connecting the pump, the odd body pipeline, or combinations thereof with the independent air cells at odd rows of the air cell rows to provide fluid flow to and/or from the independent air cells to inflate and/or deflate the independent air cells; and an even independent pipeline connecting the pump, the even body pipeline, or combinations thereof with the independent air cells at even rows of the air cell rows to provide fluid flow to and/or from the independent air cells to inflate and/or deflate the independent air cells;

wherein the independent deflating unit comprises a manual alternating device connected between the body pipelines and the independent pipelines;

the pumping assembly further comprises:

a body alternating-valve connected between the pump and the body pipelines for alternatively supplying air into the odd or even pipelines;

a first check valve connected between the odd body pipeline and the odd head air cells, the first check valve keeping the odd head air cells inflated when the body alternating-valve is operative to deflate the body air cells at the odd rows; and a second check valve connected between the even body pipeline and the even head air cells, the second check valve keeping the even head air cells inflated when the body-alternating valve is operative to deflate the body air cells at the even rows.

19. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are designed to be inflatable and deflatable, the multiple independent air cells are arranged at a central part of the mattress body and are designed to be inflatable and deflatable, the multiple body air cells are designed to be inflatable and deflatable, the independent air cells are designed to be deflatable, at least one of the independent air cells is positioned between two of the body air cells or between one of the body air cells and one of the head air cells;

a pumping assembly connecting to the mattress body and comprising an independent deflating unit connecting to the independent air cells, the pumping assembly is configured to selectively inflate and deflate the multiple body air cells, the multiple head air cells and the multiple independent air cells; and an upper bedspread covering the mattress body and connected securely to the lower bedspread, characterized in that the multiple independent air cells are inflatable and deflatable independently of the body air cells, and the head air cells, the multiple body air cells are inflatable and deflatable independently of the head air cells, the mattress body is designed to receive a bedpan when the multiple independent air cells are deflated;

wherein each body air cell gradually tapers in diameter along the complete longitudinal length of the body air cell from a wide end to a narrow end;

each independent air cell gradually tapers in diameter along the complete longitudinal length of the independent air cell from a wide end to a narrow end;

wherein the body air cells and the independent air cells are arranged with wide ends adjacent to the narrow ends;

wherein the pumping assembly comprising:

a pump;

an odd body pipeline connecting the pump with the body air cells and the head air cells at odd rows of the air cell rows to provide fluid to the body air cells and head air cells to inflate and deflate the body air cells and head air cells;

an even body pipeline connecting the pump with the body air cells and the head air cells at even rows of the air cell rows to provide fluid to the body air cells and head air cells to inflate and deflate the body air cells and head air cells;

an odd independent pipeline connecting the pump, the odd body pipeline, or combinations thereof with the independent air cells at odd rows of the air cell rows to provide fluid to the independent air cells to inflate and deflate the independent air cells; and an even independent pipeline connecting the pump, the even body pipeline, or combinations thereof with the independent air cells at even rows of the air cell rows to provide fluid to the independent air cells to inflate and deflate the independent air cells;

wherein the independent deflating unit comprises a manual alternating device connected between the body pipelines and the independent pipelines;

the pumping assembly comprises:

a body alternating-valve connected between the pump with the body pipelines and the independent pipelines;

a first check valve connected between the odd body pipeline and the odd head air cells; and a second check valve connected between the even body pipeline and the even head air cells.

20. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are configured to be inflatable and deflatable, the multiple independent air cells are arranged at a central part of the mattress body and are configured to be inflatable and deflatable, the multiple body air cells are configured to be inflatable and deflatable, at least two of the independent air cells that are positioned adjacent to one another are positioned between two of the body air cells or between one of the body air cells and one of the head air cells;

a pumping assembly connecting to the mattress body and comprising an independent deflating unit connecting to the independent air cells, the pumping assembly is configured to selectively inflate and/or deflate the multiple body air cells, the multiple head air cells and the multiple independent air cells; and an upper bedspread covering the mattress body and connected securely to the lower bedspread, characterized in that the multiple independent air cells are inflatable and/or deflatable independently of the body air cells, the multiple body air cells are inflatable and/or deflatable independently of the head air cells, the central part of the mattress body is configured to receive a bedpan when the multiple independent air cells are deflated;

wherein the pumping assembly comprising:

a pump;

an odd body pipeline connecting the pump with the body air cells and the head air cells at odd rows of the air cell rows to provide fluid flow to and/or from the body air cells and head air cells to inflate and/or deflate the body air cells and head air cells;

an even body pipeline connecting the pump with the body air cells and the head air cells at even rows of the air cell rows to provide fluid flow to and/or from the body air cells and head air cells to inflate and/or deflate the body air cells and head air cells;

an odd independent pipeline connecting the pump, the odd body pipeline, or combinations thereof with the independent air cells at odd rows of the air cell rows to provide fluid flow to and/or from the independent air cells to inflate and/or deflate the independent air cells; and an even independent pipeline connecting the pump, the even body pipeline, or combinations thereof with the independent air cells at even rows of the air cell rows to provide fluid flow to and/or from the independent air cells to inflate and/or deflate the independent air cells;

wherein the independent deflating unit comprises a manual alternating device connected between the body pipelines and the independent pipelines;

the pumping assembly further comprises:

a body alternating-valve connected between the pump with the body pipelines, the body alternating-valve configured to alternatively supplying air into one of the odd and even body pipelines;

a first check valve connected between the odd body pipeline and the odd head air cells, the first check valve operative to keep the head air cells at the odd rows inflated when the body-alternating valve is actuated to supply air to the even body pipeline; and a second check valve connected between the even body pipeline and the even head air cells, the second check valve operative to keep the head air cells at the even rows inflated when the body-alternating valve is actuated to supply air to the odd body pipeline.

21. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are configured to be inflatable and deflatable, the multiple independent air cells are arranged at a central part of the mattress body and are configured to be inflatable and deflatable, the multiple body air cells are configured to be inflatable and deflatable, a plurality of the independent air cells that are positioned adjacent to one another is positioned between two of the body air cells or between one of the body air cells and one of the head air cells;

an upper bedspread covering the mattress body and connected securely to the lower bedspread;

a pumping assembly connecting to the mattress body and comprising an independent deflating unit connecting to the independent air cells, the pumping assembly is configured to selectively inflate and/or deflate the multiple body air cells, the multiple head air cells and the multiple independent air cells, the multiple independent air cells are inflatable and/or deflatable independently of the body air cells, the multiple body air cells are inflatable and/or deflatable independently of the head air cells;

the pumping assembly further comprising:

a pump;

an odd body pipeline connecting the pump with the body air cells and the head air cells at odd rows of the air cell rows to provide fluid flow to and/or from the body air cells and head air cells to inflate and/or deflate the body air cells and head air cells;

an even body pipeline connecting the pump with the body air cells and the head air cells at even rows of the air cell rows to provide fluid flow to and/or from the body air cells and head air cells to inflate and/or deflate the body air cells and head air cells;

characterized in that an odd independent pipeline, an even independent pipeline, or combinations thereof is connected to the body pipelines in that the odd independent pipeline is connected to the odd body pipeline via an odd independent solenoid valve such that the odd independent solenoid valve is positioned between and controls air flow between the odd body pipeline and the odd independent pipeline and in that the even independent pipeline is connected to the even body pipeline via an even independent solenoid valve such that the even independent solenoid valve is positioned between and controls air flow between the even body pipeline and the even independent pipeline; and wherein the odd solenoid valve enables the independent air cells at odd rows to operate with the body air cells and the head air cells at the odd rows during inflation and with the independent air cells at even rows during deflation;

wherein the even solenoid valve enables the independent air cells at even rows to operate with the body air cells and the head air cells at even rows during inflation and with the independent air cells at odd rows during deflation; and wherein the independent air cells are deflatable independently of the body air cells to receive a bed pan.

22. The medical air mattress as claimed in claim 21, further comprising a massage unit mounted on the mattress body and having multiple micro vibrators.

23. The medical air mattress as claimed in claim 21, wherein each body air cell, each head air cell and each independent air cell are respectively uniform in diameter between a width of the mattress body when said air cells are inflated, a length of said air cells extends a full width of the mattress body.

24. The medical air mattress as claimed in claim 21, further comprising a heat unit made of carbon fiber electrothermal sheet and attached under the upper bedspread.

25. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are designed to be inflatable and deflatable, the multiple independent air cells are arranged at a central part of the mattress body and are designed to be inflatable and deflatable, the independent air cells are designed to be inflatable and deflatable, a plurality of the independent air cells that are positioned adjacent to one another is positioned between two of the body air cells; each body air cell gradually tapers in diameter along the complete longitudinal length of the body air cell from a wide end to a narrow end; and each independent air cell gradually tapers along the complete longitudinal length of the independent air cell in diameter from a wide end to a narrow end;

an upper bedspread covering the mattress body and connected securely to the lower bedspread;

a pumping assembly connecting to the mattress body and comprising an independent deflating unit connecting to the independent air cells;

the pumping assembly further comprising:

a pump;

an odd body pipeline connecting the pump with the body air cells and the head air cells at odd rows of the air cell rows;

an even body pipeline connecting the pump with the body air cells and the head air cells at even rows of the air cell rows;

characterized in that an odd independent pipeline, an even independent pipeline, or combinations thereof is connected to the body pipelines in that the odd independent pipeline is connected to the odd body pipeline via an odd independent solenoid valve such that the odd independent solenoid valve is positioned between and controls air flow between the pump and the odd independent pipeline and in that the even independent pipeline is connected to the even body pipeline via an even independent solenoid valve such that the even independent solenoid valve is positioned between and controls air flow between the pump and the even independent pipeline; and wherein the independent air cells are deflatable independently of the body air cells to receive a bed pan.

26. The medical air mattress as claimed in claim 25, wherein the body air cells and the independent air cells are arranged with wide ends adjacent to the narrow ends.

27. A medical air mattress comprising:

a mattress body mounted on the lower bedspread and comprising multiple body air cells and multiple independent air cells, the multiple body air cells and the multiple independent air cells are positioned parallel to each other and arranged in a row to form air cell rows, the multiple independent air cells are arranged at a central part of the mattress body and are configured to be inflatable and deflatable, the multiple body air cells are configured to be inflatable and deflatable, a plurality of the independent air cells is positioned between two of the body air cells, each body air cell and each independent air cell are respectively uniform in diameter between a width of the mattress body when said air cells are inflated, a length of each of said air cells extends a full width of the mattress body;

a pumping assembly connecting to the mattress body, the pumping assembly is configured to selectively inflate and/or deflate the multiple body air cells and the multiple independent air cells, said pumping assembly comprising:

a body pipeline that connects the pump with the body air cells;

an independent pipeline that connects the pump with the independent cells, the independent pipeline is connected to the pump via the body pipeline;

an independent deflating unit connecting the independent pipeline to the body pipeline, the independent deflating unit configured to selectively inflate and/or deflate the independent air cells;

wherein the pump supplies air into the body pipeline to inflate the independent air cells with the body air cells by operation of the independent deflating unit in a first position, and the body pipeline keeps supplying the air to the body air cells when the independent deflating unit is operative to deflate the independent air cells in a second position;

an upper bedspread covering the mattress body and connected securely to the lower bedspread, characterized in that the multiple independent air cells are inflatable and/or deflatable independently of the body air cells, the central part of the mattress body is configured to receive a bedpan when the multiple independent air cells are deflated.

28. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are designed to be inflatable and deflatable, the multiple independent air cells are arranged at a central part of the mattress body and are designed to be inflatable and deflatable, the independent air cells are designed to be deflatable, at least one of the independent air cells is positioned between two of the body air cells or between one of the body air cells and one of the head air cells;

a pumping assembly connecting to the mattress body and comprising an independent deflating unit connecting to the independent air cells; and an upper bedspread covering the mattress body and connected securely to the lower bedspread, characterized in that the multiple independent air cells are deflatable independently of the body air cells, the head air cells, or combination thereof, the mattress body is designed to receive a bedpan when the multiple independent air cells are deflated;

wherein each body air cell gradually tapers in diameter along the complete longitudinal length of the body air cell from a wide end to a narrow end; and, each independent air cell gradually tapers in diameter along the complete longitudinal length of the independent air cell from a wide end to a narrow end.

29. The medical air mattress as claimed in claim 28, wherein the body air cells and the independent air cells are arranged with wide ends adjacent to the narrow ends.

30. A medical air mattress comprising:

a lower bedspread;

a mattress body mounted on the lower bedspread and comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are designed to be inflatable and deflatable, the multiple independent air cells are arranged at a central part of the mattress body and are designed to be inflatable and deflatable, the independent air cells are designed to be deflatable, a plurality of the independent air cells that are positioned adjacent to one is positioned between two of the body air cells;

an upper bedspread covering the mattress body and connected securely to the lower bedspread;

a pumping assembly connecting to the mattress body and comprising an independent deflating unit connecting to the independent air cells;

the pumping assembly further comprising:

a pump;

an odd body pipeline connecting the pump with the body air cells and the head air cells at odd rows of the air cell rows;

an even body pipeline connecting the pump with the body air cells and the head air cells at even rows of the air cell rows;

characterized in that an odd independent pipeline, an even independent pipeline, or combinations thereof is connected to the body pipelines in that the odd independent pipeline is connected to the odd body pipeline via an odd independent solenoid valve such that the odd independent solenoid valve is positioned between and controls air flow between the pump and the odd independent pipeline and in that the even independent pipeline is connected to the even body pipeline via an even independent solenoid valve such that the even independent solenoid valve is positioned between and controls air flow between the pump and the even independent pipeline;

wherein each body air cell gradually tapers in diameter along the complete longitudinal length of the body air cell from a wide end to a narrow end; and, each independent air cell gradually tapers in diameter along the complete longitudinal length of the independent air cell from a wide end to a narrow end.

31. The medical air mattress as claimed in claim 30, wherein the independent air cells are deflatable independently of the body air cells to receive a bed pan.

32. The medical air mattress as claimed in claim 31, wherein the body air cells and the independent air cells are arranged with wide ends adjacent to the narrow ends.

33. A medical air mattress comprising:

a lower bedspread;

a mattress body mounted on the lower bedspread and comprising a plurality of body air cells, a plurality of head air cells and a plurality of independent air cells, the plurality of body air cells, the plurality of head air cells and the plurality of independent air cells are all inflatable and deflatable, the plurality of head air cells are arranged at a head end of the mattress body, at least two of the head air cells are positioned adjacent to one another, the plurality of independent air cells are arranged at a central part of the mattress body, at least two of the independent air cells are positioned adjacent to one another, at least two of the body air cells are positioned adjacent to one another, at least one of the independent air cells is positioned between two of the body air cells or between one of the body air cells and one of the head air cells; and, a pumping assembly connecting to the mattress body, comprising:

a pump, a body pipeline that connects the pump with the body air cells and the head air cells, an independent pipeline that connects the pump with the independent air cells, the independent pipeline is connected to the pump via the body pipeline, and an independent deflating unit positioned between the independent pipeline and the body pipeline to control air flow between the body pipeline to the independent pipeline, the independent deflating unit is configured for selectively deflating the independent air cells;

wherein when the independent deflating unit is operative to independently deflate the plurality of independent air cells, the pumping assembly being configured to supply air to the body pipeline to inflate odd and/or even body air cells and odd and/or even head air cells, and the pumping assembly being further configured to supply air from the body pipeline to the independent pipeline; and wherein the mattress body defining a bedpan region to receive a bedpan when the independent air cells are deflated and the odd and/or even body air cells are kept inflated, the bedpan region unable to receive a bedpan when the independent air cells are inflated.

34. The medical air mattress as defined in claim 33, wherein a plurality of the independent air cells is positioned between one of the body air cells and one of the head air cells.

35. The medical air mattress as defined in claim 34, wherein the mattress body includes a longitudinal length that extends along a longitudinal axis and a width that extends along a lateral axis that is transverse to the longitudinal axis, a longitudinal axis of the body air cells positioned parallel to the lateral axis of the mattress body, a longitudinal axis of the head air cells positioned parallel to the lateral axis of the mattress body, a longitudinal axis of the independent air cells positioned parallel to the lateral axis of the mattress body, a longitudinal length of the body air cells extending substantially a full width of the mattress body, and a longitudinal length of the head air cells extending substantially a full width of the mattress body.

36. The medical air mattress as defined in claim 33, wherein the mattress body includes a longitudinal length that extends along a longitudinal axis and a width that extends along a lateral axis that is transverse to the longitudinal axis, a longitudinal axis of the body air cells positioned parallel to the lateral axis of the mattress body, a longitudinal axis of the head air cells positioned parallel to the lateral axis of the mattress body, a longitudinal axis of the independent air cells positioned parallel to the lateral axis of the mattress body, and wherein a) a longitudinal length of the body air cells extending substantially a full width of the mattress body, b) a longitudinal length of the head air cells extending substantially a full width of the mattress body, c) a longitudinal length of the independent air cells extending substantially a full width of the mattress body, or a combination of a), b) or c).

37. The medical air mattress as defined in claim 33, wherein the mattress body includes a longitudinal length that extends along a longitudinal axis and a width that extends along a lateral axis that is transverse to the longitudinal axis, a longitudinal axis of the body air cells positioned parallel to the lateral axis of the mattress body, a longitudinal axis of the head air cells positioned parallel to the lateral axis of the mattress body, a longitudinal axis of the independent air cells positioned parallel to the lateral axis of the mattress body, a longitudinal length of the body air cells extending substantially a full width of the mattress body, and a longitudinal length of the head air cells extending substantially a full width of the mattress body.

38. A method for creating a bedpan space while a patient is supported on a medical air mattress comprising multiple body air cells, multiple head air cells and multiple independent air cells, the multiple body air cells, the multiple head air cells and the multiple independent air cells are positioned parallel to each other and arranged in a row to form air cell rows, the multiple head air cells are arranged at a head end of the mattress body and are configured to be inflatable and deflatable, the multiple independent air cells are arranged at a central part of the mattress body and are configured to be inflatable and deflatable, the multiple body air cells are configured to be inflatable and deflatable, at least one of the independent air cells is positioned between two of the body air cells or between one of the body air cells and one of the head air cells, the medical air mattress further comprising a body pipeline that connects the pump with the body air cells and the head air cells, an independent pipeline that connects the pump with the independent air cells via the body pipeline, and an independent valve connecting the independent pipeline to the body pipeline, the method comprising:

supplying air from the pump to the body pipeline to inflate the body air cells and/or the head air cells;

in response to an independent valve being operative to inflate the independent air cells, supplying air from the body pipeline to the independent pipeline to inflate odd and/or even independent air cells;

in response to the independent valve being operative to deflate the independent air cells; exhausting air from the independent pipeline to deflate the independent air cells, and keeping a supply of the air to the odd and/or even body air cells and/or the odd and/or even head air cells via the body pipeline.

39. A method for creating a bedpan space while a patient is supported on a medical air mattress, the medical air mattress comprising multiple body air cells and independent air cells, said multiple body air cells and independent air cells at least partially form a mattress body, the body air cells and independent air cells being parallel to each other and arranged in a row to form air cell rows, each body air cell and each independent air cell are respectively uniform in diameter between a width of the mattress body when said air cells are inflated, a length of each of said air cells extends a full width of the mattress body, the method comprising:

supplying air into a body pipeline connected between a pump and the body air cells, the body pipeline configured for delivering air to the body air cells;

supplying the air into an independent valve connected between the body pipeline and an independent pipeline, the independent pipeline configured for delivering fluid to the independent air cells;

in response to operating the independent valve, deflating the independent air cells while continuing to inflate the odd and/or even body air cells using the body air pipeline;

wherein the independent air cells are arranged at a central part of the mattress body, wherein by operation of the independent valve, at least one of the deflated independent air cells are recessed adjacent to the inflated body air cells to create a space for a bedpan.

40. The method according to claim 39, wherein the body pipeline includes an odd and an even pipeline each connecting the pump with the body air cells at alternating cell rows, wherein the independent pipeline includes an odd and even independent pipeline each connecting the pump with the independent air cells at alternating rows, the method further comprising:

operating the independent valve to inflate odd independent air cells with odd body air cells during inflation; and operating the independent valve to deflate the odd independent air cells with even independent air cells during deflation.

41. The method according to claim 39, wherein the body air cells are tapered from a wide end to a narrow end.

42. The method according to claim 39, wherein the body pipeline includes an odd and an even pipeline each connecting the pump with the body air cells at alternating air cell rows, the method further comprising:

supplying the air into a body-alternating valve connected between the pump and the odd and even pipelines;

controlling operation of the body-alternating valve for alternatively supplying the air into the odd or even body pipeline, in response to operating the body-alternating valve in a first mode, supplying the air to the odd body pipeline for inflating the body air cells at odd rows of the air cell rows and not supplying the air to the even body pipeline for deflating the body air cells at even rows of the air cell rows;

in response to operating the body-alternating valve in a second mode, supplying the air to the even body pipeline for inflating the body air cells at the even rows of the air cell rows and not supplying the air to the odd body pipeline for deflating the body air cells at the odd rows of the air cell rows.

43. The method according to claim 42, wherein the odd and even body pipelines further connects the pump with head air cells, the head air cells are positioned parallel to each other and arranged in a row to form air cell rows, the head air cells are arranged at a head end of the mattress body and are configured to be inflatable and deflatable;

the method further comprising:

controlling operation of a check valve connected to one of the odd and even body pipelines;

wherein in response to operating an even check valve connected to the even body pipeline, keeping the head air cells inflated at the even rows of the air cell rows without deflating by the body-alternating valve;

wherein in response to operating an odd check valve connected to the odd body pipeline, keeping the head air cells inflated at the odd rows of the air cell rows without deflating by the body-alternating valve.

44. A method for operating a medical air mattress comprising multiple body air cells and multiple independent air cells, said multiple body air cells and independent air cells at least partially form a mattress body, the multiple body and independent air cells are positioned parallel to each other and arranged in a row to form air cells rows, the body air cells are configured to be inflatable and deflatable, the independent air cells are configured to be inflatable and deflatable, each body air cell and each independent air cell are respectively uniform in diameter between a width of the mattress body when said air cells are inflated, a length of each of said air cells extends a full width of the mattress body, the method comprising:

supplying air into a body-alternating valve connected between a pump and an odd and even pipeline;

controlling operation of the body-alternating valve for alternatively supplying the air into an odd or even body pipeline, the odd body pipeline connecting the pump with the body air cells at odd rows of the air cell rows, the even body pipeline connecting the pump with the body air cells at even rows of the air cell rows;

in response to operating the body-alternating valve in a first mode, supplying the air to the odd body pipeline for inflating the body air cells at the odd rows of the air cell rows and not supplying the air to the even body pipeline for deflating the body air cells at the even rows of the air cell rows;

in response to operating the body-alternating valve in a second mode, supplying the air to the even body pipeline for inflating the body air cells at the even rows of the air cell rows and not supplying the air to the odd body pipeline for deflating the body air cells at the odd rows of the air cell rows; and deflating at least one of the independent air cells independently of at least one adjacently positioned inflated body air cell to create a space for a bedpan.

45. The method according to claim 44, wherein the body air cells are tapered from a wide end to a narrow end.

46. The method according to claim 44, wherein the odd and even body pipelines further connects the pump with head air cells, the head air cells are positioned parallel to each other and arranged in a row to form air cell rows, the head air cells are arranged at a head end of the mattress body and are configured to be inflatable and deflatable;

the method further comprising:

controlling operation of a check valve connected to one of the odd and even body pipelines;

wherein in response to operating an even check valve connected to the even body pipeline, keeping the head air cells inflated at the even rows of the air cell rows without deflating by the body-alternating valve;

wherein in response to operating an odd check valve connected to the odd body pipeline, keeping the head air cells inflated at the odd rows of the air cell rows without deflating by the body-alternating valve.

* * * * *